US009896901B2

(12) United States Patent
Sommers

(10) Patent No.: US 9,896,901 B2
(45) Date of Patent: Feb. 20, 2018

(54) IPACKER BRIDGE PLUG WITH SLIPS

(71) Applicant: Target Completions, LLC, Broken Arrow, OK (US)

(72) Inventor: Michael Sommers, Broken Arrow, OK (US)

(73) Assignee: Target Completions, LLC, Broken Arrow, OK (US)

( * ) Notice: Subject to any disclaimer, the term of this patent is extended or adjusted under 35 U.S.C. 154(b) by 0 days.

(21) Appl. No.: 14/552,142

(22) Filed: Nov. 24, 2014

(65) Prior Publication Data

US 2016/0138363 A1 May 19, 2016

Related U.S. Application Data

(60) Provisional application No. 61/907,447, filed on Nov. 22, 2013, provisional application No. 62/051,694, filed on Sep. 17, 2014.

(51) Int. Cl.

| | |
|---|---|
| ***E21B 23/06*** | (2006.01) |
| ***E21B 33/124*** | (2006.01) |
| ***E21B 23/01*** | (2006.01) |
| ***E21B 33/129*** | (2006.01) |
| ***E21B 34/16*** | (2006.01) |
| ***E21B 34/00*** | (2006.01) |
| ***E21B 33/128*** | (2006.01) |
| ***E21B 33/134*** | (2006.01) |

(52) U.S. Cl.

CPC ..... *E21B 33/1292* (2013.01); *E21B 23/06* (2013.01); *E21B 33/128* (2013.01); *E21B 33/129* (2013.01); *E21B 33/134* (2013.01)

(58) Field of Classification Search

None

See application file for complete search history.

(56) References Cited

U.S. PATENT DOCUMENTS

| | | | | |
|---|---|---|---|---|
| 6,131,656 | A | 10/2000 | Jani | |
| 6,394,180 | B1 | 5/2002 | Berscheidt et al. | |
| 8,205,671 | B1 | 6/2012 | Branton | |
| 8,336,635 | B2 * | 12/2012 | Greenlee | E21B 23/006 166/202 |
| 8,596,347 | B2 | 12/2013 | Valencia et al. | |
| 9,010,411 | B1 * | 4/2015 | VanLue | E21B 33/128 166/118 |
| 9,062,543 | B1 | 6/2015 | Snider et al. | |
| 9,243,472 | B1 | 1/2016 | Snider et al. | |

(Continued)

OTHER PUBLICATIONS

Letter of David W. Carstens, Esquire dated Jun. 14, 2016 (NPL 1).

(Continued)

*Primary Examiner* — Matthew R Buck
*Assistant Examiner* — Douglas S Wood
(74) *Attorney, Agent, or Firm* — Merek, Blackmon & Voorhees, LLC

(57) ABSTRACT

The present invention is to a packer plug that can be tripped into a particular location in a well bore and set using slips or expansion rings and packer elements. The plug presents little flow resistance because of its wide inner diameter throat through the mandrel. A ball seat at an upper end allows for the sealing of the interior passage. The ball can be flowed upward or dissolved to remove the seal and allow flow through the plug.

19 Claims, 5 Drawing Sheets

(56) References Cited

U.S. PATENT DOCUMENTS

| | | | | |
|---|---|---|---|---|
| 9,284,803 | B2 * | 3/2016 | Stone | E21B 23/00 |
| 2014/0190685 | A1 * | 7/2014 | Frazier | E21B 33/1208 166/250.01 |

OTHER PUBLICATIONS

Letter of David W. Carstens, Esquire dated Jul. 25, 2016 (NPL 2).
International Search Report dated Mar. 11, 2015 issued in connection with PCT/US14/167158 (NPL 3).

* cited by examiner

IPACKER BRIDGE PLUG WITH SLIPS

CROSS REFERENCE TO RELATED APPLICATIONS

This application claims the benefit of U.S. Provisional Application 61/907,447, filed Nov. 22, 2013, entitled "Packer Bridge Plug with Slips," which is incorporated herein by reference. This application also claims the benefit of U.S. Provisional Application 62/051,694, filed Sep. 14, 2014, entitled "Packer Bridge Plug with Slips," which is incorporated herein by reference.

BACKGROUND OF THE INVENTION

Field of the Invention

The present invention relates to a bridge plug packer having a ball seat and packer element for sealing one zone of a well from another.

In the process of fracking, it is expensive to run tools into and out of the well. It is therefore desirable to run in tools that can serve multiple purposes during the fracking process. The present invention in at least one embodiment is to a packer tool that can be used to seal a well bore and when the ball is removed presents only a small resistance to the production flow up through the plug.

SUMMARY OF THE INVENTION

Accordingly, it is a principal object of a preferred embodiment of the invention to provide a packer plug that can be tripped into a particular location in a well bore and set using slips or expansion rings and packer elements. The plug presents little flow resistance because of its wide inner diameter throat through the mandrel. A ball seat at an upper end allows for the sealing of the interior passage. The ball can be flowed upward or dissolved to remove the seal and allow flow through the plug.

It is another object of the invention to provide a selectively sealable down hole tool that can be sealed and unsealed during the facking process without having to trip the entire tool back up the well bore.

It is a further object of the invention to a bridge plug for use with a removable ball or with a dissolvable ball to allow production flow through the tool without requiring removal of the tool.

Still another object of the invention is to provide a down hole tool that can be set with a setting tool to set one or more bridge plugs in series to isolate a number of zones in a well bore which can be selectively unsealed to allow production flow through the tool.

It is an object of the invention to provide improved elements and arrangements thereof in an apparatus for the purposes described which is inexpensive, dependable and fully effective in accomplishing its intended purposes.

These and other objects of the present invention will be readily apparent upon review of the following detailed description of the invention and the accompanying drawings. These objects of the present invention are not exhaustive and are not to be construed as limiting the scope of the claimed invention. Further, it must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

BRIEF DESCRIPTION OF THE DRAWINGS

Similar reference characters denote corresponding features consistently throughout the attached drawings.

DETAILED DESCRIPTION

The present invention relates to a bridge plug packer having slips.

A bridge plug is used to isolate a zone below the plug. It is desirable to make a bridge plug that can be reversed by simply flowing fluid up from beneath the plug. The current inventions shows one such plug 10 in the Figures.

Figure 1:
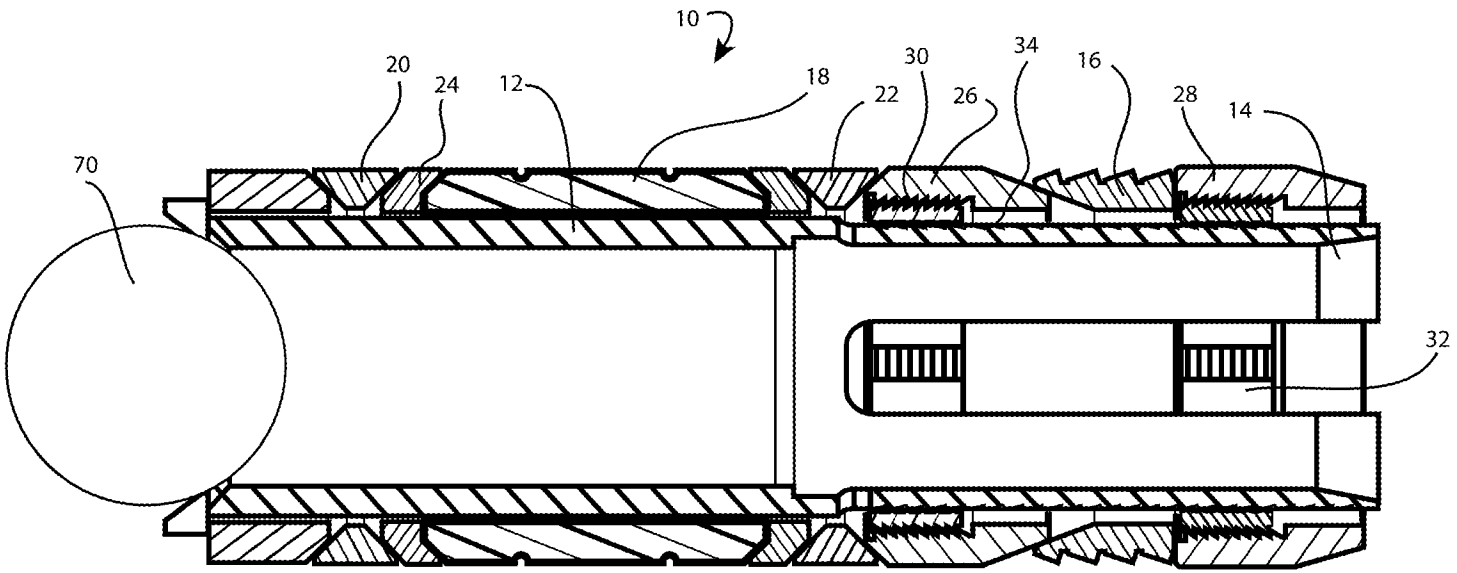
FIG. 1 is cross-sectional view of a bridge plug packer according to at least one embodiment of the invention.

FIG. 1 shows a bridge plug 10. The plug has a central body 12 terminating in a collet 14. The bridge plug 10 has a set of slips 16 on the bottom end of the packer that when set keep the frac plug 10 in place. The rubber element/packer 18 is contained between the expansion rings 20 on the top and the expansion rings 22 above the cone on the bottom. The expansion rings may have a cut section to allow the rings to contract and expand. A rubber retainer ring 24 may be provided on either side of the packer to retain the packer in position on the plug 10. As the expansion rings are compressed towards each other the rubber packer 18 expands outwardly to lock the plug in place and isolates the zone upstream of the plug from the downstream zone.

The slips 16 are located between an upper cone 26 and a lower cone 28. Upper cone 28 has locknut 30 and lower cone 28 includes a locknut 32. These locknuts cooperate with threading/ridges 34 on the mandrel/central body 12 to selectively locate the cones at a particular axial location along the mandrel to for example, retain the slips in a deployed status. Preferably the mandrel 12 includes threads 34 that allow the lower locknut 32 to be threaded into position, but the threads also cooperate with the locknut to act as a ratchet so that the mandrel can move downwardly past the locknut when the setting tool strokes or when a downward force acts on the mandrel body to further set the slips 16.

A number of shear pins 36 (FIG. 2) are provided to lock the upper and lower cones relative to the mandrel before setting. As described lower under, when the pins shear under downward pressure from the mandrel, the cones compress the slip, forcing the slip outward to engage the well bore (not shown). The pressure required to shear the pins may vary according to the application, but are preferably set to shear during the stroking of the setting tool.

In operation, the plug is run in the well with wireline pump down, tractor or tubing (not shown). The plug is set with a special setting kit 50 (FIG. 3) that attaches to the bottom section of the Packer plug by a setting collet 52. The setting collet is arranged such that the setting collet arms fall within the voids between the main mandrel 12 collet arms.

The ends of the setting collet arms extend outwardly to engage with the lower cone. The setting mandrel 50 body prevents the setting collet arms from moving inward. A shear ring 54 is provided to release the setting kit mandrel body at the appropriate time. When the setting mandrel body is removed, the setting collet 52 arms can move inwardly to release the kit from the bridge plug 10. The setting mandrel body has a limited "lost motion" where the setting mandrel body can move relative to the setting collet before the mandrel body hits a shoulder 56 of the collet. When the setting mandrel body is thus positioned, the collet arms can retract. Further movement of the setting mandrel body upward causes a shoulder of the setting mandrel body 50 to force the setting collet body upward with the setting mandrel body so that the setting kit can be removed from the bridge plug entirely. A cap (not shown) may be provided at the terminus of the setting mandrel body to keep the sheer ring from falling off entirely from the setting kit.

Figure 2:
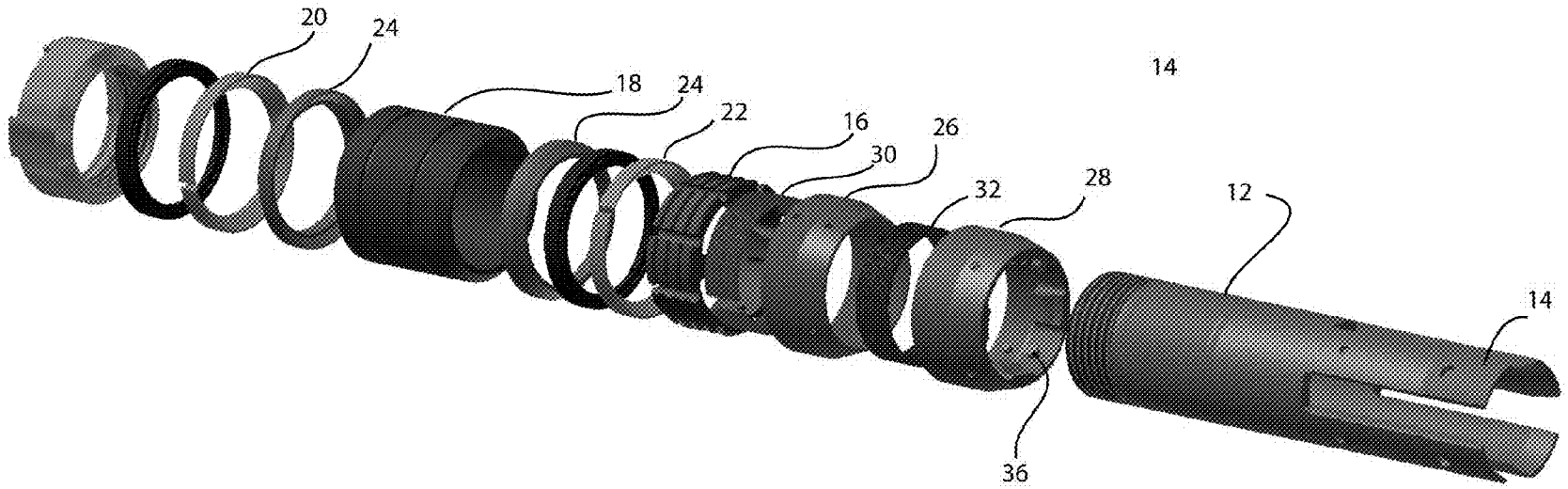
FIG. 2 is an exploded view of the bridge plug according to the embodiment of FIG. 1.
Figure 3:
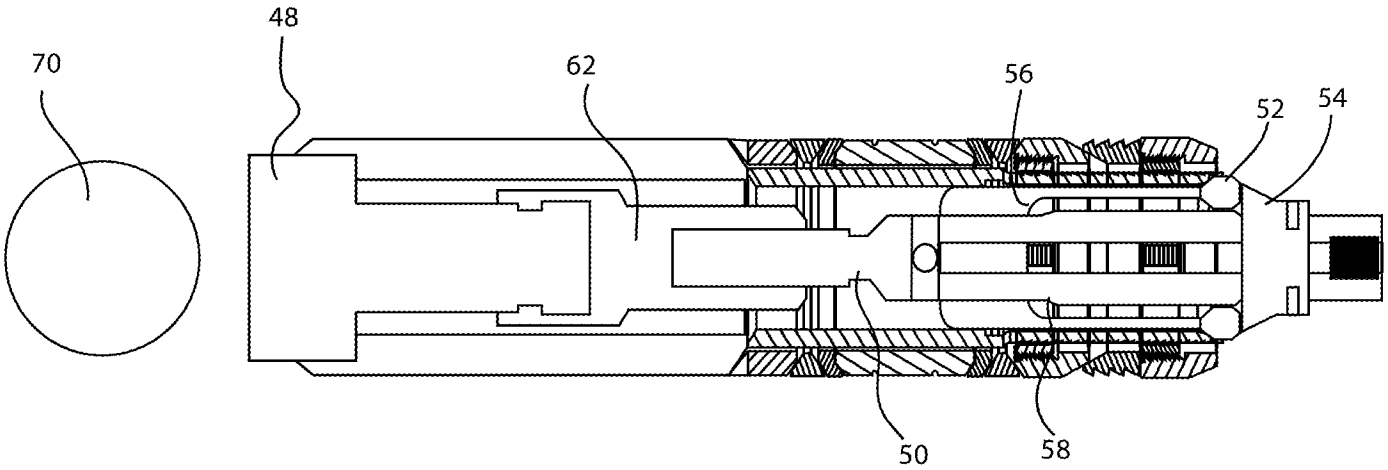
FIG. 3 is a cross-sectional view of a setting tool and bridge plug for running into a well bore.

FIG. 3 shows a setting gun 48 inside a setting sleeve attached to the bridge plug by the setting kit and ready for insertion into a well bore. The setting gun is connected to the setting kit mandrel by adapter sleeve 62, which is attached to the bridge plug by collet 52 which is held in place by shear ring 54. The setting tool includes a collet 56 that includes a number arms/fingers 52. The arms are sized and arranged to fit within the slots provided on the collet 14 of the mandrel body 12 (FIG. 2). This provides a shorter tool and provides for a fixed orientation of the setting tool relative to the mandrel during tripping in and setting.

During setting, the tools are tripped into a well bore to a desired location. The slips are partially set as the tool is tripped in to provide some resistance. This resistance causes the packer elements to partially set. The setting tool then strokes the bottom of the setting tool pulls up on the lower cone 28. Threads 32 allow the lower cone to raise up along the mandrel body pushing the slips against upper cone 26. The conical section of the cone 26 slides within the slips 16 to expand the slips. Frangible sections between the slips allow the slips to further expand.

The setting tool further compresses the bridge plug causing the rings around the packer element to compress the packer element 18 therebetween. While optional, the rings provide a buffer around the packer element. The rings may have precut sections to allow the rings to expand as well along with the packer element.

When the force reaches a sufficient pressure to shear the shear pins on the setting mandrel, the pin(s) shear on the lock ring 54 to separate the lock ring from the setting body. The shear ring collects at a lower portion of the shear kit so that it can be retrieved with the tool.

With the lock ring removed, the setting tool 50 can move upward relative to the plug mandrel body 12. The setting tool can move upward within the mandrel 12 so that the expanded section 58 of the setting tool is moved axially above the collet arms and fingers 52. With the reduced neck of the setting tool beneath the fingers 52, the fingers are free to collapse inwardly. As the shoulder of the expanded section hits the base 56 of the setting tool collet, the fingers 52 collapse allowing the setting tool to release from the bridge plug mandrel 12. The setting tool is then tripped up leaving the bridge plug set in place. Because the bridge plug is hollow, fluid can still flow unobstructed through the well bore. The cylindrical shape of the tool allows for the flow to bridge plug to only have a minor impact on flow through the well bore.

The next operation is to isolate the zones below the plug by pumping a ball on to the top of the Packer Plug. A ball 70 is pumped down from surface and lands on the top of the Packer Plug blocking flow through the interior of the bridge plug as the packer element blocks flow around the bridge plug. The additional feature of the ball landing on the top of the Packer plug is that this pushes additional force on the mandrel though the lock nut and down to the low slips. This force energizes the element more and puts more energy into the slips of the Packer tool.

The final operation is the flow back and production. With the mandrel being a large cast iron Mandrel, the fluids and gasses in the well will not break down the tool like a composite plug. Because the Bottom of the Packer mandrel has a collet style design with arms having ample voids between the arms, the well fluids will flow around any ball that comes in contact with the bottom of the Packer mandrel and will flow through the voids in the collet and through the interior of the bridge plug.

Additional Embodiments

Figure 5:
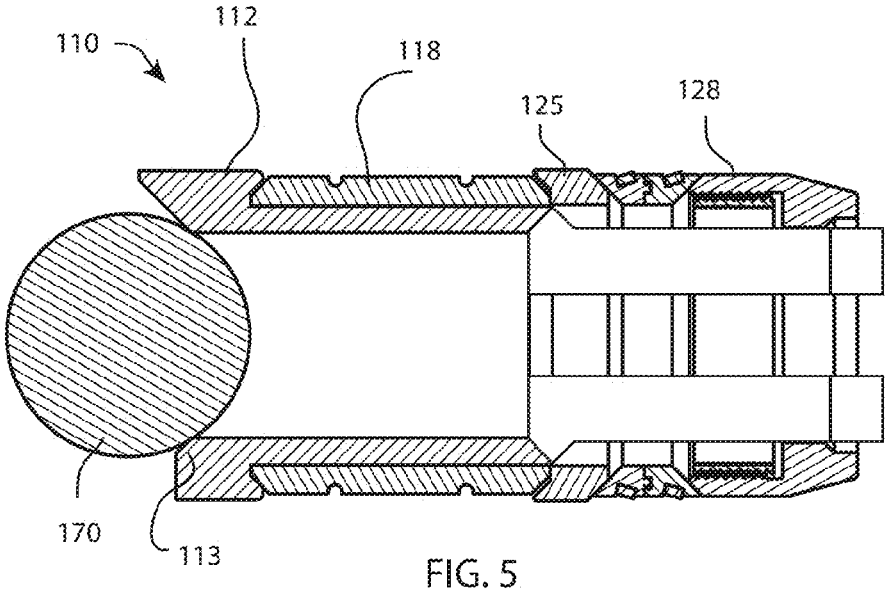
FIG. 5 is a cross-sectional view of a bridge plug according to the further embodiment of FIG. 4.
Figure 4:
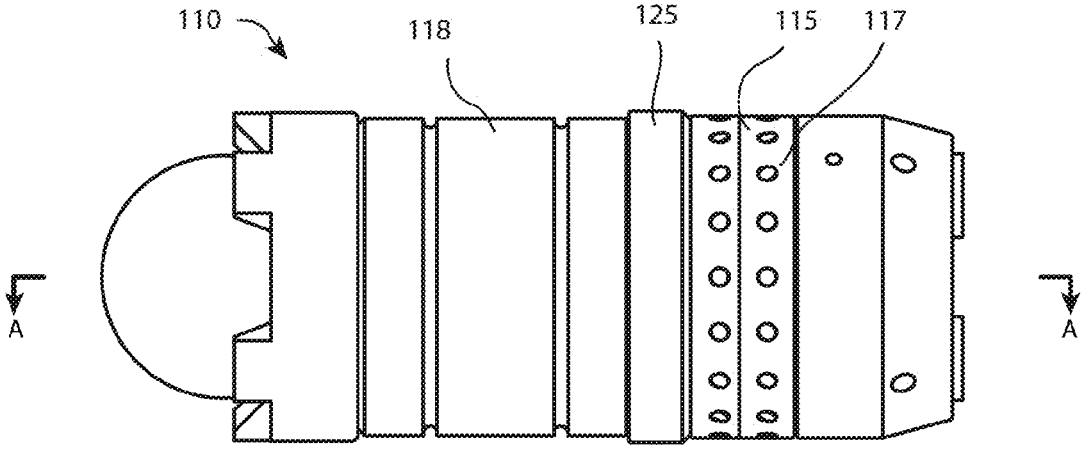
FIG. 4 is a front plan view of a bridge plug according to a further embodiment of the invention.
Figure 6:
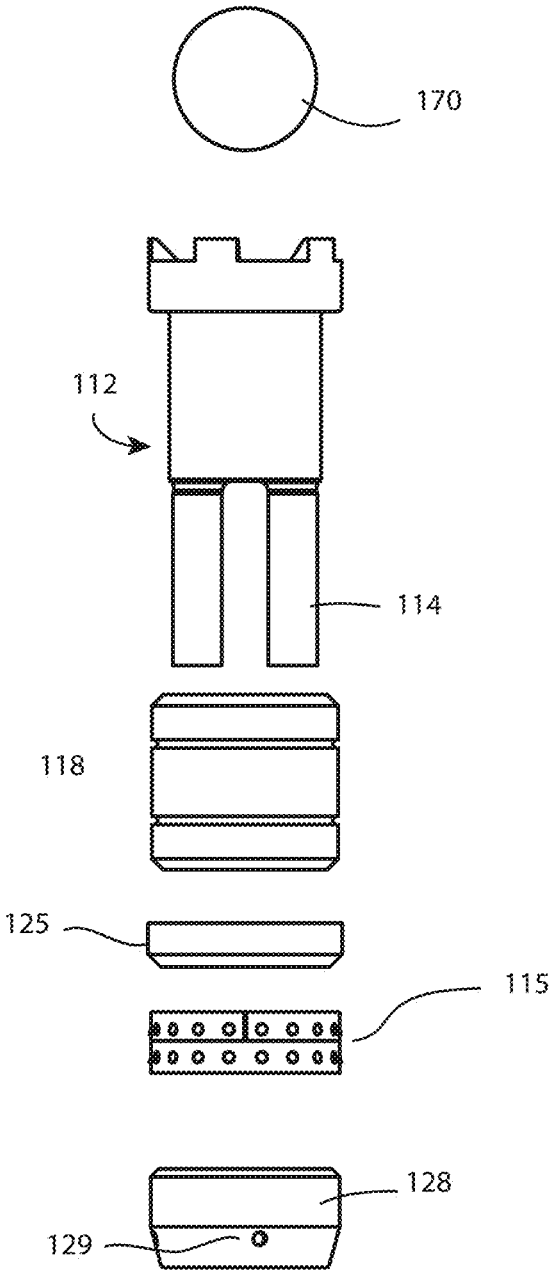
FIG. 6 is an exploded view of a bridge plug according to the further embodiment of FIG. 4.

FIGS. 4-6 show a further embodiment of the invention having expansion rings instead of slips. The arrangement of this embodiment allows for a simplified design and a reduced overall length of the tool.

The tool 110 has a central mandrel 112 having a packer element 118 mounted thereon. The mandrel includes a ball seat 113 for the ball 170 to seal the inner passageway through the mandrel. The lower end of mandrel body includes collet fingers 114 for attaching additional elements to the mandrel. A frustoconical ring 125 takes the place of upper cone 26. The lower cone 128 has a conical surface to enclose a number of expansion rings 115 between the lower cone 128 and the ring 125 and to force the expansion rings to expand when compressed between the lower cone 128 and the ring 125. The expansion rings 115 may have a weakened area or a cut to allow the rings to expand when compressed between the conical surfaces. The expansion ring may have additional friction elements 117 to provide a secure bite between the bridge plug and the well casing when it is desired to set the plug in place. The frictional elements could be made of carbide or may be wickers similar to the slip design of the first embodiment. Other materials including metals and ceramics could be used for the construction of the frictional elements 117 depending on the application.

In practice, the lower cone is threaded onto the mandrel body and shear pinned into place. A setting tool similar to FIG. 3 is used to bottom set the bridge plug in place. During setting, the lower cone shears the pin 129 and moves upwardly along the mandrel body to compress the expansion rings between the cone of the lower cone 128 and the ring 125 forcing the expansion rings outward. the expansion rings engage the inner wall of the casing as they expand forcing the expansion rings and/or the frictional elements 117 into frictional engagement with the casing to affix the bridge plug into place. Further compression expands the packer element 118 outward to prevent any flow around the outside of the bridge plug. A ball 170 is then dropped into place to selectively seal the bridge plug. If required, the ball can be dissolved or removed to reopen the flow through the tool to allow production or other flow therethrough without requiring the removal of the tool.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as maybe applied to the central features hereinbefore set forth, and fall within the scope of the invention and the limits of the appended claims. It is therefore to be understood that the present invention is not limited to the sole embodiment described above, but encompasses any and all embodiments within the scope of the following claims.

I claim:

1. A bridge plug for sealing a well bore comprising:

a mandrel having a tubular body and a collet, said collet having a plurality of arms and a plurality of voids, each of said plurality of voids being formed between a pair of adjacent arms and said collet being formed in a lower end of said mandrel;

a ball seat at an upper end of the mandrel for receiving a ball to seal flow downwardly through the tubular body;

a packer element mounted to the mandrel for selectively sealing flow outside the tubular body;

an upper conical body mounted on the mandrel, and a lower conical body mounted on a lower portion of the moundrel;

at least one friction ring mounted between the upper conical body and the lower conical body causing the at least one friction ring to expand away from the mandrel when the at least one friction ring slides over the upper conical body; and a series of threads on a locknut mounted on the mandrel cooperating with threads on the upper conical body for threading said upper conical body onto said mandrel and for acting as a ratchet to hold said upper conical body relative to said mandrel when said upper conical body is moved along said mandrel.

2. The bridge plug of claim 1, wherein:

the at least one friction ring is an expansion ring having a plurality of raised friction elements along the circumference of the at least one friction ring.

3. The bridge plug of claim 1, wherein:

the at least one friction ring is an expansion ring having a plurality of raised carbide friction elements along the circumference of the at least one friction ring.

4. The bridge plug of claim 1, wherein:

the at least one friction ring is a series of slips along the at least one friction ring.

5. A method of sealing a well bore comprising:

providing a bridge plug having a mandrel with a tubular body, a collet and a passageway extending through the tubular body, said collet having a plurality of arms and a plurality of voids, each of said plurality of voids being formed between a pair of adjacent arms; providing a ball seat at an upper end of the mandrel for receiving a ball to seal flow through the mandrel; providing the collet at a lower end of the mandrel; mounting a packer element to the mandrel for selectively sealing flow outside the mandrel; slidably mounting an upper conical body on the mandrel; slidably mounting a lower conical body on the plurality of collet arms; providing at least one friction ring mounted between the upper conical body and the lower conical body; providing a setting tool for acting on said lower conical body and said upper conical body to set the bridge plug at a desired location in a well bore casing; setting said bridge plug in place in said well bore casing by moving the lower conical body towards said upper conical body to force said at least one friction ring along a sloped surface of the upper conical body to expand said at least one friction ring into engagement with said well bore casing to lock said bridge plug in place relative to said well bore casing.

6. The method of sealing a well bore of claim 5, further comprising:

further setting said bridge plug by moving said upper conical body along said mandrel to compress said packer element to cause said packer element to expand outwardly to seal the bridge plug to the well bore casing to prevent flow along said packer element between the well bore casing and the mandrel.

7. The method of sealing a well bore of claim 5, further comprising:

dropping a ball onto said ball seat to prevent flow downwardly through said passageway extending through said tubular body.

8. The method of sealing a well bore of claim 5, wherein:

the at least one friction ring is an expansion ring having a plurality of raised friction elements along the circumference of the at least one friction ring.

9. The method of sealing a well bore of claim 5, wherein:

the at least one friction ring is an expansion ring having a plurality of raised carbide friction elements along the circumference of the at least one friction ring.

10. The method of sealing a well bore of claim 5, wherein:

the at least one friction ring is a series of slips along the at least one friction ring.

11. An apparatus for sealing a well bore, said apparatus comprising:

a first bridge plug including a mandrel having a tubular body, a ball seat and a collet, said ball seat being formed in an upper end of said mandrel for receiving a first ball to seal said tubular body such that fluid cannot flow downwardly through said tubular body, said collet being formed in a lower portion of said mandrel, said collet having a lower end that contacts a second ball from a second bridge plug positioned below said first bridge plug when fluid is directed upwardly through a well bore during a production operation causing the second ball from the second bridge plug to flow upwardly into contact with said lower end of said collet, said collet having a plurality of arms and a plurality of voids, each of said plurality of voids allows fluid to enter said tubular body of said first bridge plug during the production operation when the second ball is in contact with the lower end of said collet; a packer element mounted on said mandrel for selectively sealing flow outside said mandrel; and, at least one expandable member mounted on the plurality of collet arms, said at least one expandable member being configured to expand away from said mandrel to set said first bridge plug at a desired location.

12. The apparatus for sealing a well bore as set forth in claim 11, wherein:

said tubular body, said ball seat and said collet are formed from a single piece of material.

13. The apparatus for sealing a well bore as set forth in claim 11, further including:

an upper conical body mounted on said mandrel and a lower conical body mounted on said mandrel.

14. The apparatus for sealing a well bore as set forth in claim 13, wherein:

said at least one expandable member is configured to expand away from said mandrel when said at least one expandable member slides on a portion of said upper conical body.

15. The apparatus for sealing a well bore as set forth in claim 11, wherein:

said at least one expandable member includes a plurality of friction elements extending outwardly from said at least one expandable member.

16. The apparatus for sealing a well bore as set forth in claim 11, wherein:

said mandrel has external threads formed in an outer surface of said mandrel adjacent said upper end of said mandrel.

17. The apparatus for sealing a well bore as set forth in claim 11, wherein: each of said plurality of voids has an open end formed in a lowermost portion of said mandrel.

18. The apparatus for sealing a well bore as set forth in claim 11, wherein:

said plurality of arms includes a first arm and a second arm, said plurality of voids includes a first void formed between said first arm and said second arm and said first void extends along an entire length of said first arm.

19. The apparatus for sealing a well bore as set forth in claim 18, wherein:

said first void extends along an entire length of said second arm.

* * * * *